US008770971B2

(12) United States Patent
Boren

(10) Patent No.: US 8,770,971 B2
(45) Date of Patent: Jul. 8, 2014

(54) MOBILE SURGICAL DENTAL CHAIR AND METHOD OF MANUFACTURE

(75) Inventor: Culberson Boren, Tyler, TX (US)

(73) Assignee: Boren Pediatric Surgical Solutions, L.L.C., Tyler, TX (US)

( * ) Notice: Subject to any disclaimer, the term of this patent is extended or adjusted under 35 U.S.C. 154(b) by 127 days.

(21) Appl. No.: 13/023,349

(22) Filed: Feb. 8, 2011

(65) Prior Publication Data

US 2011/0195374 A1 Aug. 11, 2011

Related U.S. Application Data

(60) Provisional application No. 61/302,268, filed on Feb. 8, 2010.

(51) Int. Cl.
*A61G 15/00* (2006.01)

(52) U.S. Cl.
USPC ..... 433/33

(58) Field of Classification Search
USPC ..... 433/33, 77, 82, 98, 99, 100
See application file for complete search history.

(56) References Cited

U.S. PATENT DOCUMENTS

| | | | | |
|---|---|---|---|---|
| 3,081,542 | A * | 3/1963 | Sherfey | 433/33 |
| 3,386,766 | A * | 6/1968 | Gorelick | 297/188.05 |
| 3,771,226 | A * | 11/1973 | Lieb et al. | 433/33 |
| 3,838,687 | A * | 10/1974 | Mosher | 128/200.11 |
| 4,453,768 | A | 6/1984 | Cranford, Jr. et al. | |
| 5,225,172 | A * | 7/1993 | Meyler et al. | 422/300 |
| 5,259,365 | A * | 11/1993 | Nishikori et al. | 600/102 |
| 5,490,716 | A | 2/1996 | Naughton | |
| 2002/0106606 | A1 | 8/2002 | Eikenberg | |
| 2004/0059197 | A1* | 3/2004 | Yamashita et al. | 600/300 |
| 2004/0174054 | A1* | 9/2004 | Franke | 297/217.3 |
| 2009/0241269 | A1* | 10/2009 | Yoo et al. | 8/149.3 |
| 2011/0059416 | A1 | 3/2011 | Lee | |

FOREIGN PATENT DOCUMENTS

| | | |
|---|---|---|
| DE | 23 32 087 A1 | 1/1975 |
| JP | 2000 166996 A | 6/2000 |

OTHER PUBLICATIONS

Boyd, "Pediatric Dental Catalog," 24 pages, May 2008.
PCT, Notification of Transmittal of the International Search Report and the Written Opinion of the International Searching Authority, or the Declaration, PCT Rule 44.1, International application No. PCT/US2011/024054, Mailed May 31, 2011, 8 pages.
Yokota Ichiro, Patent Abstracts of Japan, Publication No. 2000166996, Publication Date Jun. 2, 2000, Application No. 10346388, 1 page.

* cited by examiner

*Primary Examiner* — Sunil K Singh
(74) *Attorney, Agent, or Firm* — Baker Botts L.L.P.

(57) ABSTRACT

According to one embodiment, a mobile surgical dental chair includes an adjustable backrest, an adjustable headrest, a plurality of locking wheels configured to provide mobility to the mobile surgical dental chair, dental tools integrated with and coupled to the mobile surgical dental chair, and connect hook-ups configured to connect the dental tools to one or more supply sources. The dental tools may include an air/water syringe, suction tube, and a rotary hand piece.

10 Claims, 3 Drawing Sheets

MOBILE SURGICAL DENTAL CHAIR AND METHOD OF MANUFACTURE

RELATED APPLICATIONS

This application claims the benefit under 35 U.S.C. §119 (e) of U.S. Provisional Application Ser. No. 61/302,268 filed Feb. 8, 2010.

TECHNICAL FIELD

This invention relates generally to surgical dentistry and in particular to a mobile surgical dental chair and method of manufacture.

BACKGROUND

Pediatric Dentistry (formerly Pedodontics/Paedodontics) is the branch of dentistry dealing with children from birth through adolescence. Pediatric surgery is a subspecialty of surgery involving the surgery of fetuses, infants, children, adolescents, and young adults. Many pediatric dentists and surgeons practice at children's hospitals. Oral and maxillofacial surgery is sometimes performed to correct various diseases, injuries, or defects in the head, neck, face, jaws or the hard and soft tissues of the oral and maxillofacial region. Pediatric Dentistry and oral and maxillofacial surgery are recognized international surgical specialties. The instruments used in certain procedures performed at least in part by pediatric dentists, pediatric surgeons, and/or oral and maxillofacial surgeons may differ, in certain instances, from the instruments used in other types of medical fields.

SUMMARY

In an apparatus embodiment, a mobile surgical dental chair includes an adjustable backrest, an adjustable headrest, a plurality of locking wheels configured to provide mobility to the mobile surgical dental chair, dental tools integrated with and coupled to the mobile surgical dental chair, and connect hook-ups configured to connect the dental tools to one or more supply sources. In certain embodiments, the dental tools may include air/water syringes, suction tubing, various rotary hand pieces, and/or other suitable dental tools.

Particular embodiments may provide one or more technical advantages. In certain embodiments, a mobile surgical dental chair may facilitate performing dentistry and surgery, including pediatric dentistry and surgery, in any suitable location. For example, certain embodiments may enable the performance of medical procedures within a hospital, a surgical center, an outpatient facility, a medical tent or other temporary shelter, a vehicle such as an ambulance, plane, or a ship, and/or any other suitable location. In particular instances, a mobile surgical dental chair may be used in remote areas of the world where normal dental and surgical services are not readily available but may be in great demand by needy children and adults alike. In particular instances, a mobile surgical dental chair may be equipped with a power supply (e.g., one or more batteries) and/or a gas supply (e.g., compressed air or nitrogen), such that certain features may be enabled either with or without an external power supply and/or an external gas supply connected to the mobile surgical dental chair. Particular embodiments may enable the rapid, secure, and efficient transport of instruments that may be used in various medical procedures including, for example, pediatric dentistry and oral and maxillofacial surgeries. In addition, the mobile surgical dental chair may enable a dental pediatric practitioner or other oral facial surgeons to stand or sit to perform medical procedures on patients of a variety of different ages and/or sizes including, for example, pediatric, adult, and geriatric patients. In certain instances, the mobile surgical dental chair may be transported from one location to another while the mobile surgical dental chair is providing various functions. In particular embodiments, the surgical dental chair may be equipped with one or more a drawers configured to sterilize instruments that may be stored therein. In certain embodiments, the surgical dental chair may be equipped with one or more lockable drawers that may be used to secure instruments stored therein.

Certain embodiments may provide all, some, or none of these advantages. Certain embodiments may provide one or more other advantages, one or more of which may be apparent to those skilled in the art from the figures, descriptions, and claims included herein.

BRIEF DESCRIPTION OF THE DRAWINGS

For a more complete understanding of the present invention and advantages thereof, reference is now made to the following description taken in conjunction with the accompanying drawings, in which.

DESCRIPTION OF EXAMPLE EMBODIMENTS

According to the present invention, a mobile surgical dental chair and method of manufacture are provided. It should be understood at the outset that although example implementations of embodiments of the invention are illustrated below, the present invention may be implemented using any number of techniques, whether currently known or in existence. The present invention should in no way be limited to the example implementations, drawings, and techniques illustrated below. Additionally, the drawings are not necessarily drawn to scale.

Figure 1:
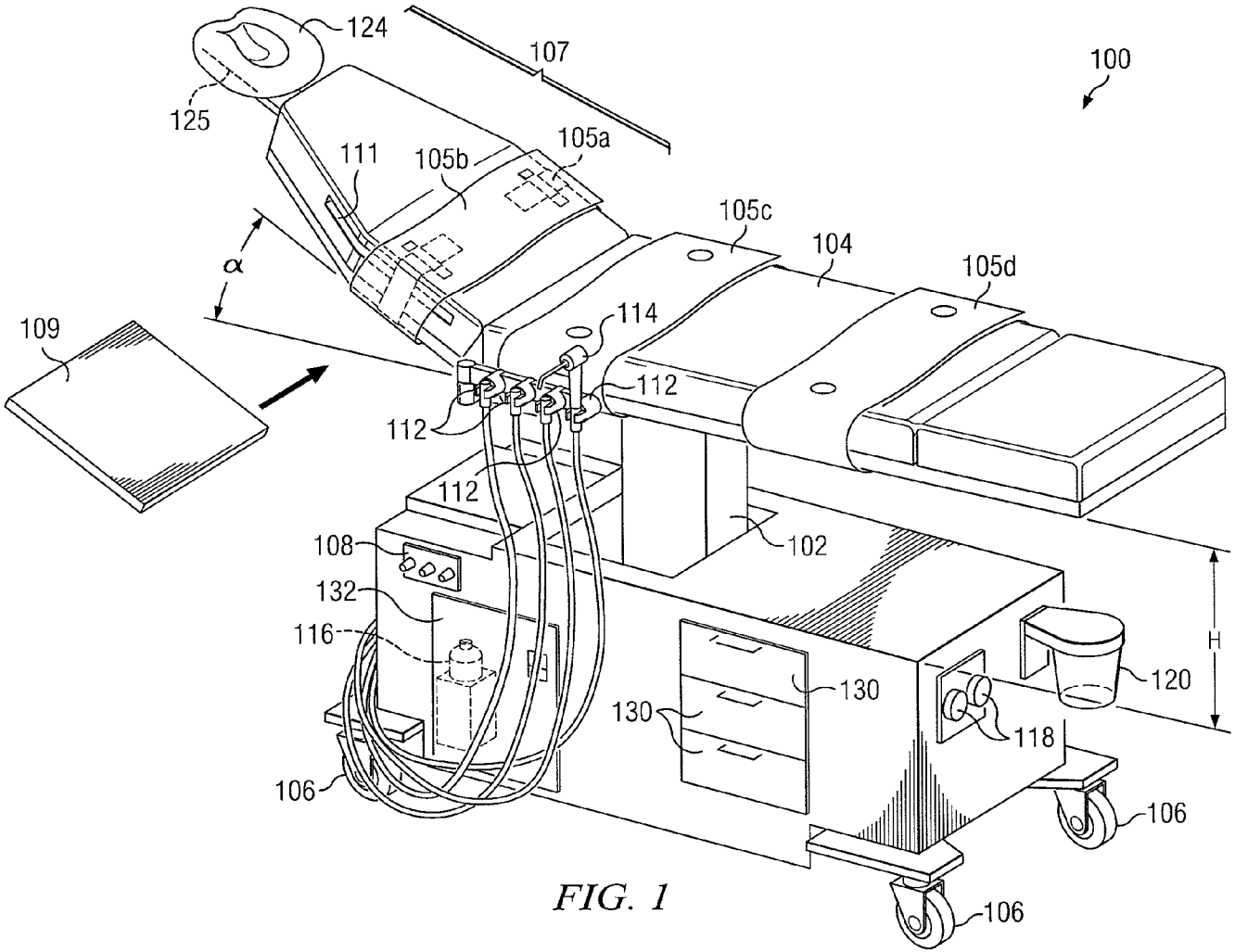
FIGS. 1 through 3 show different perspective views of a surgical dental chair according to one embodiment.
Figure 2:
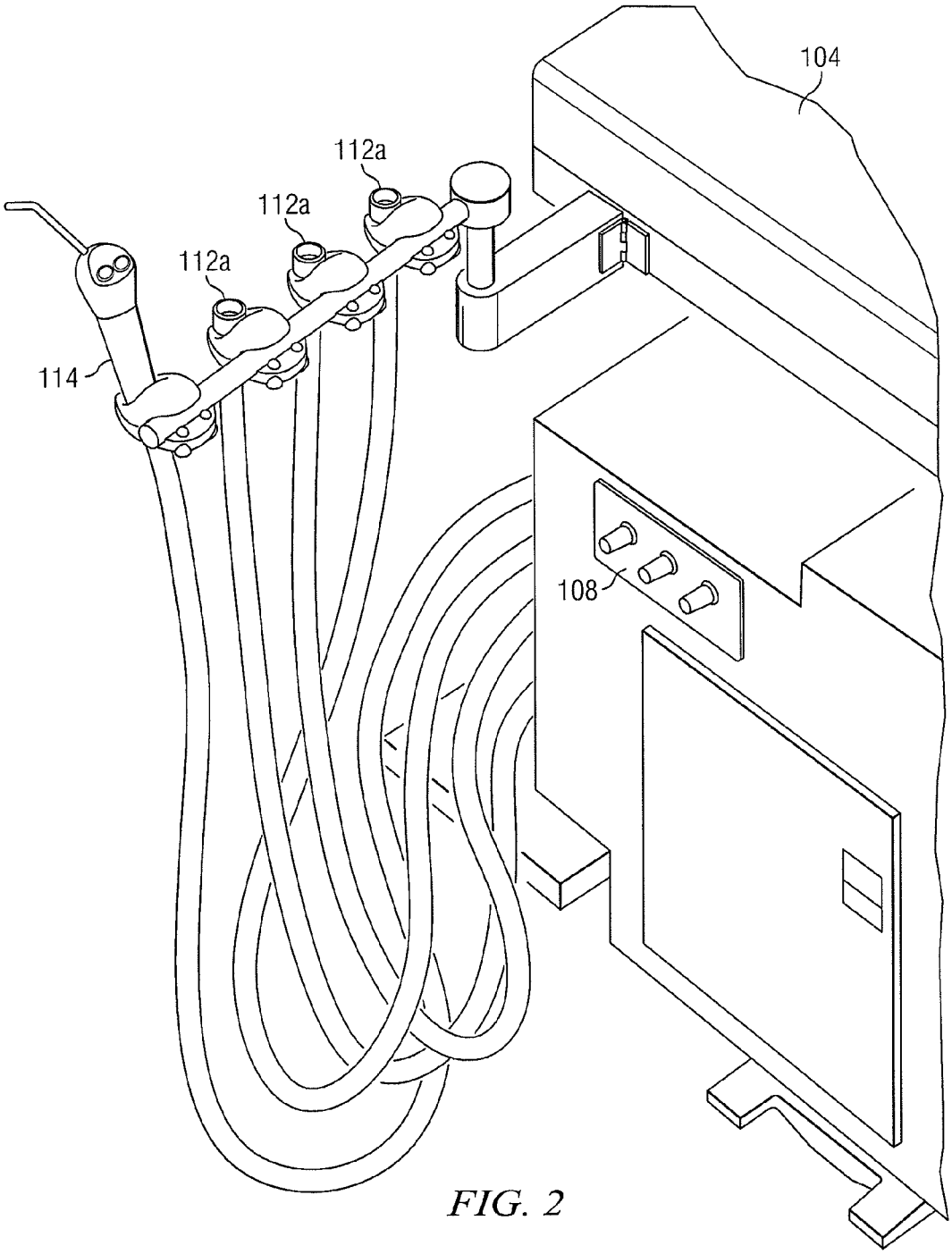
Figure 3:
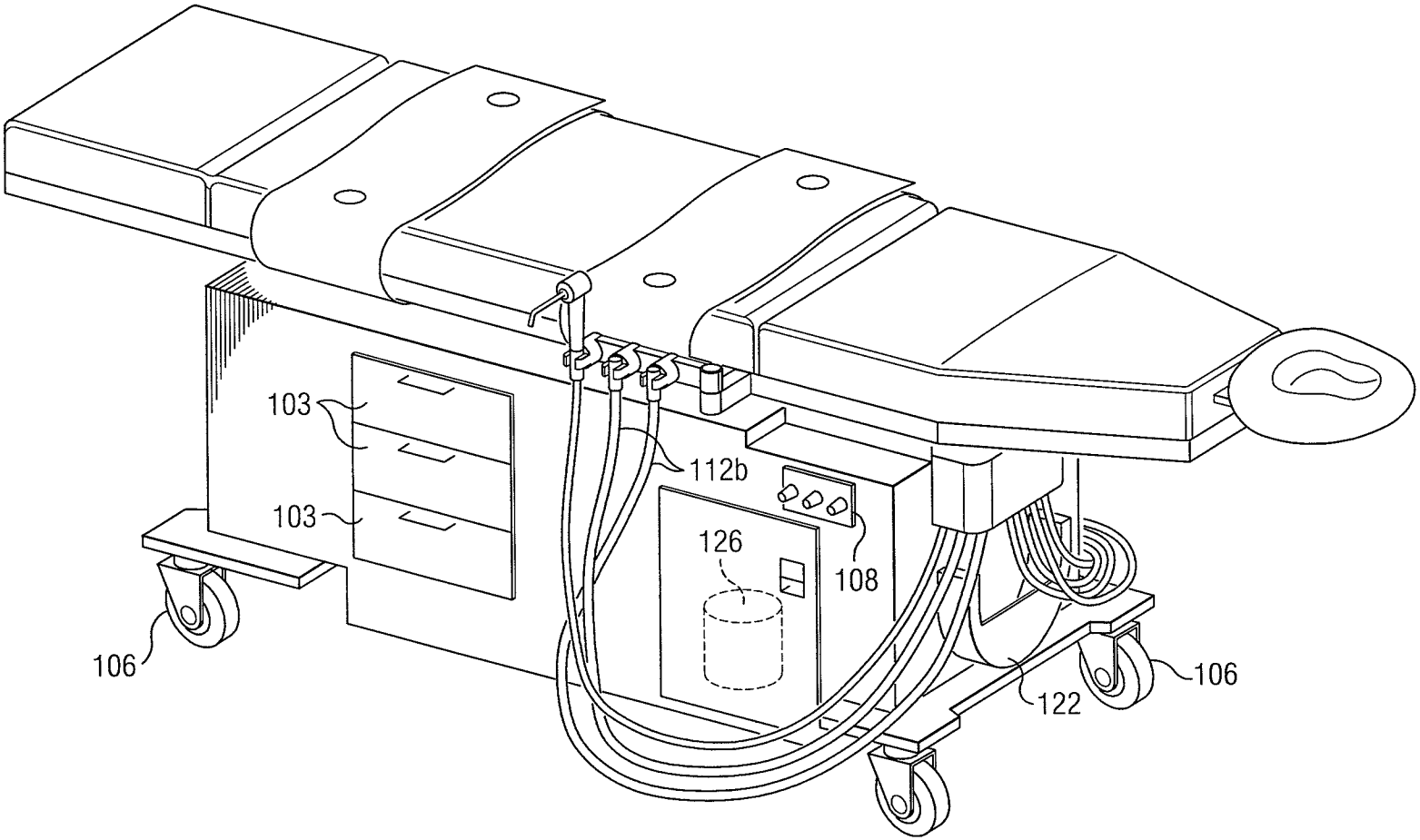

FIGS. 1 through 3 show different perspective views of a surgical dental chair 100. In a particular embodiment, surgical dental chair 100 may include one or more of the following features: one or more vertical elevation motors 102; an adjustable bench 104 including removable restraints 105; at least four wheels 106; enclosed electronics 108; handpiece connectors 112; one or more air-water syringes 114; a heated, sterile water bottle 116; one or more connectors 118; a disposable collection container 120; foot pedal carrier 122 for quick transportation and storage of one or more foot pedals; a removable headrest 124; one or more supply sources 126; one or more drawers 130 and/or compartments 132 configured to receive and store instruments; and/or any suitable instrument or accessory that facilitate medical procedures. As explained further below, mobile surgical dental chair 100 may facilitate performing dentistry and oral or maxillofacial surgery, including pediatric dentistry and surgery, at any suitable location. In particular instances, mobile surgical dental chair 100 may be used in remote areas of the world where normal dental and surgical services are not readily available but may be in great demand by needy children and adults alike. In addition, mobile surgical dental chair 100 may be used at locations where consistent power and/or gas supplies may not be readily available.

In certain embodiments, portions of mobile surgical dental chair 100 may be at least partially formed from stainless steel (e.g., drawers 130 and/or compartments 132) or leather (e.g., bench 104 and/or restraints 105); however, any suitable material or materials may be used.

In certain embodiments, one or more vertical elevation motors 102 may be configured to mechanically reposition at least a portion of the mobile surgical dental chair 100 along an adjustable height axis H. For example, vertical elevation motor 102 may be configured to adjust the height of bench 104 of surgical dental chair 100 from zero to eight inches, zero to ten inches, or any other suitable range. In a particular embodiment, control for vertical adjustment of the one or more vertical elevation motors may be provided by a foot pedal. In certain embodiments, a system including one or more vertical elevation motors 102 may enable a dental pediatric practitioner or other oral facial surgeons to stand or sit as desired to perform medical procedures on patients of a variety of different ages and/or sizes including, for example, pediatric, adult, and geriatric patients.

In certain embodiments, either or both ends of bench 104 may be hinged, thereby allowing portions of bench 104 to fold. The folding of bench 104 may minimize the horizontal space of mobile surgical dental chair 100, which in certain instances may facilitate transportation of mobile surgical dental chair 100. In addition, bench 104 may be hinged in a manner that facilitates adjusting the head and/or back of a patient at an angle $\alpha$ relative to the remainder of bench 104. For example, bench 104 may be hinged to allow adjustment of the head of a patient in an upward or downward direction of up to ten inches or more, and at an angle of up to 40 degrees or more, relative to the remainder of bench 104. Although particular example adjustment ranges are disclosed, bench 104 may be hinged and/or may be partitioned in a manner that provides any suitable ranges of upward, downward, and/or angular adjustments. In certain embodiments, a motor may facilitate positioning a portion of bench 104 (e.g., portion 107) at an angle $\alpha$ relative to the remainder of bench 104, as shown in FIG. 1.

In particular embodiments, bench 104 may be configured to comfortably position and secure patients to mobile surgical dental chair 100. Bench 104 may be adaptable for securely and comfortably positioning patients of a variety of different ages and sizes. For example, bench 104 may be customizable to more securely and comfortably position pediatric patients, teen-age patients, adult patients, and/or geriatric patients. In certain embodiments, bench 104 may be configured to receive any one of a set of removable restraints 105.

Each restraint 105 may be used to comfortably secure a patient to bench 104. For example, particular restraints 105 may be used to secure a patient's wrists (e.g., restraints 105*b* or 105*c*), torso (e.g., restraints 105*b* or 105*c*) and/or feet (e.g., restraint 105*d*) to bench 104. Each restraint 105 may be sized, positioned, and/or tightened according to the particular restraining needs of a patient. For example, certain restraints 105*a*-105*b* may be configured for pediatric patients. Other restraints 105*c*-105*d* may be configured for adult patients. In certain instances, the restraints 105 may be foldable or may roll up for storage. Certain restraints 105 may be stored, for example, in a drawer 130, compartment 132, beneath bench 104, and/or at another suitable storage space of mobile surgical dental chair 100.

In a particular embodiment, an upper portion of bench 104 may include an integrated papoose rest 107 configured to securely and comfortably position in infant or small child to mobile surgical dental chair 100. The papoose rest 107 may include wrist strap restraints 105*b* that wrap around bench 104 and are secured beneath bench 104 by Velcro or other suitable fastener. In certain embodiments, wrist strap restraints 105*b* may be coupled to the inside of a larger restraint 105*c* configured to wrap around the torso of a pediatric patient. When not in use, the papoose rest 107, including wrist restraints 105*a*-105*b*, may be configured to store flat underneath the upper portion of bench 104.

In particular embodiments, bench 104 may include a heating pad 109. The heating pad 109 may be used, for example, to ensure that the patient maintains a body temperature within the range of 97 to 98 degrees Fahrenheit. In certain embodiments, bench 104 may include a compartment 111 that receives a removable heating pad 109. The heating pad 109 may, for example, be secured inside a compartment 111 of bench 104 by Velcro, a zipper, one or more snaps, or other suitable fastener. According to one embodiment, the heating pad 109 is positioned within bench 104 proximate to the integrated papoose rest 107, thereby enabling temperature regulation for an infant or small child during a procedure. Although FIG. 1 shows that heating pad 109 may be inserted into bench 104 from the side, other configurations for the insertion of heating pad 109 may be used. For example, in one alternative embodiment heating pad 109 may be inserted in an opening disposed between the two portions of bench 104 that are separated by a hinge (e.g., at the hinge separating papoose rest 107 from the remainder of bench 104). In particular embodiments, bench 104 may be configured to receive heating pad 109 and/or a second heating pad 109 at a location near restraint 105*c* and/or between restraints 105*c* and 105*d*. In certain embodiments, the heating element of heating pad 109 may be based on circulated water within heating pad 109; however, any suitable heating element may be used.

In particular embodiments, each wheel 106 may be a locking caster that enables independent motion relative to the other wheels 106. Control panel 108 may provide manual controls to operate the various features of mobile surgical dental chair 100. In certain embodiments, control panel 108 may be retractable to allow access to additional controls. Certain motors 110 may be independent twenty-four volt direct current (DC) motors.

In certain embodiments, handpiece connectors 112*a* may each be a six-pin LED connector; however, any suitable connectors may be used. In particular embodiments, handpiece connectors 112*b* may each provide high volume suction; however, any suitable connectors may be used. In certain instances, the arm supporting handpiece connector 112*a* and the arm supporting handpiece connector 112*b* may be interchanged, depending on which side of bench 104 those instruments will be used. In addition, the arms supporting handpiece connectors 112 each include a plurality of elbows, thereby enabling the articulation of those arms and the ability to fold those arms flat against mobile surgical dental chair 100. As shown in FIG. 2, the arms supporting handpiece connectors 112 may be telescopic, thereby enabling vertical positioning of those arms.

In certain embodiments, mobile surgical dental chair 100 may include an internal system configured to heat a sterile water bottle 116. For example, mobile surgical dental chair 100 may include a socket disposed within a compartment 132 that receives and warms water bottle 116. In particular embodiments, water bottle 116 may have a holding capacity of within the range of 1 liter to 3 liters; however, any suitable capacity may be used. In certain embodiments, water bottle 116 may be used to contain liquid other than water. In particular embodiments, water bottle 116 may provide a source of pressurized, heated, sterile water for use in a medical procedure.

In certain embodiments, each connector 118 enable mobile surgical dental chair 100 to couple to a particular line. In certain embodiments, connectors 118 may include one or more quick disconnects that enable quickly disconnecting the coupled line. In particular embodiments, connectors 118 include one or more volume suction connects, vacuum connectors, nitrogen connectors, compressed air connectors, and/or power connectors. Particular connectors 118 may be retractable. In certain embodiments, connectors 112 and 118 are operated, at least in part, by one or more air sources.

In certain embodiments, disposable collection container 120 may be located at foot of chair as shown; however, any suitable location may be used for disposable collection container 120. In certain instances, disposable collection container 120 may be used is collect biohazard fluids and other debris generated during a medical procedure. In particular embodiments, collection and disposal of the contents of container 120 may be compatible with hospital collection containers.

In certain embodiments, adjustable headrest 124 may be adjusted (e.g., upward or downward). A downward adjustment of headrest 124 may provide ease of intubation and accessibility of maxillary arch. Adjustable headrest 124 may have a donut-shaped depression configured to facilitate positioning of a patient's head and to stabilize a patient's head. Adjustable headrest 124 may be one of a set of different, interchangeable headrests 128 that may each be removably coupled to mobile surgical dental chair 100. For example, each adjustable headrest 124 may be secured to surgical dental chair by one or more snaps, Velcro, latches, any combination of the preceding, and/or other suitable fasteners. Each adjustable headrest 124 of the set may be configured to fit a respective range of head sizes. For example, at least one of the set of adjustable headrests may configured to fit a range of head sizes corresponding to pediatric patients and at least another one may be configured to fit a range of head sizes corresponding to adult patients. In certain instances, such as when performing procedures for tiny infants, adjustable headrest 124 be removed.

In a particular embodiment, adjustable headrest 124 may include a sleeve, slot, strap, and/or other device 125 configured to hold various monitor cords (e.g., electrocardiography wires, temperature probe, pulse oximeter, Christmas tree support bracket that may hold anesthesia tubing for patient respiration, etc.) along the edge of the adjustable headrest, thereby keeping the monitor cords off the ground and/or otherwise out of the way.

In particular instances, mobile surgical dental chair 100 may be equipped with one or more supply sources 126. For example, mobile surgical dental chair 100 may be equipped with a power supply (e.g., one or more batteries, power generators, and/or other sources of electricity) and/or a gas supply 126 (e.g., compressed air, compressed nitrogen, and/or other compressed gases), such that certain features may be enabled either with or without an external power supply and/or an external gas supply connected to the mobile surgical dental chair.

In certain embodiments, one or more drawers 130 may be securable by locks that are opened using a key, touchpad, biometric security, etc. Particular embodiments may include one or more drawers 130 configured to sterilize instruments, for example when the drawer is returned to a closed position. Any suitable sterilization technique may be used, including, for example: steam, water, disinfectant, ultrasound, and/or any combination of these or other suitable sterilization techniques. In various embodiments, a sterilizing drawer 130 may be configured to transport instruments enclosed therein in a sterilized state while the mobile surgical dental chair is displaced (e.g., transferred from one room to another or from one position within a room to another position within the room, such as from the center of the room to a position against a wall).

In operation, certain embodiments may enable the performance of medical procedures within a hospital, a surgical center, an outpatient facility, a medical tent or other temporary shelter, a vehicle such as an ambulance, plane, or a ship, and/or any other suitable location. In particular instances, a mobile surgical dental chair may be used in remote areas of the world where normal dental and surgical services are not readily available but may be in great demand by needy children and adults alike. In certain instances, mobile surgical dental chair 100 may be transported from one location to another while the mobile surgical dental chair is providing the various functions disclosed herein. Particular embodiments may enable the rapid, secure, and efficient transport of instruments that may be used in various medical procedures including, for example, pediatric dentistry and oral and maxillofacial surgeries. Although particular embodiments are described in the context of dentistry and oral or maxillofacial surgery, mobile surgical dental chair 100 may be used to perform medical procedures in a variety of other medical fields. For example, mobile surgical dental chair 100 may be used to for normal dental procedures.

Although the present disclosure has been described above in connection with several embodiments, a myriad of changes, substitutions, variations, alterations, transformations, and modifications may be suggested to one skilled in the art, and it is intended that the present invention encompass such changes, substitutions, variations, alterations, transformations, and modifications as fall within the spirit and scope of the appended claims.

What is claimed is:

1. A mobile surgical dental chair, comprising:

an adjustable backrest;

an adjustable headrest having a donut-shaped depression configured to facilitate positioning of a patient's head during oral surgery;

a plurality of locking wheels configured to provide mobility to the mobile surgical dental chair;

dental tools integrated with and coupled to the mobile surgical dental chair, the dental tools comprising an air/water syringe, suction tube, and a rotary hand piece;

connect hook-ups configured to connect the dental tools to one or more supply sources; and at least one drawer coupled to the mobile surgical dental chair, the at least one drawer configured to steam-sanitize a plurality of instruments while the at least one drawer is closed and coupled to the mobile surgical dental chair.

2. The mobile surgical dental chair of claim 1, wherein the one or more supply sources are selected from the group consisting of:

pressurized air;

pressurized nitrogen;

suction;

pressurized water; and electrical power.

3. The mobile surgical dental chair of claim 1, further comprising one or more motors configured to mechanically reposition at least a portion of the mobile surgical dental chair.

4. The mobile surgical dental chair of claim 1, further comprising one or more straps configured to restrain a pediatric patient.

5. The mobile surgical dental chair of claim 1, wherein the plurality of instruments comprise one or more dental and/or surgical instruments.

6. The mobile surgical dental chair of claim 1, wherein the at least one drawer comprises a lock.

7. The mobile surgical dental chair of claim 1, wherein the at least one drawer is configured to steam-sanitize the plurality of instruments while the at least one drawer is operating on battery power.

8. The mobile surgical dental chair of claim 1, wherein the at least one drawer is configured to steam-sanitize the plurality of instruments while the mobile surgical dental chair is disconnected from an alternating current supply source.

9. The mobile surgical dental chair of claim 1, wherein the adjustable headrest is one of a plurality of removable headrests, each one of the plurality of removable headrests configured to fit a respective range of head sizes, wherein at least one of the plurality of removable headrests is configured to fit a range of head sizes corresponding to pediatric patients.

10. The mobile surgical dental chair of claim 1, wherein the adjustable backrest comprises a removable heating pad.

* * * * *